United States Patent [19]

Kogure et al.

[11] Patent Number: 4,672,831

[45] Date of Patent: Jun. 16, 1987

[54] BENDING PRESS

[75] Inventors: Tsuneo Kogure; Yuji Tsuchiyama, both of Hatano; Tadashi Amano, Sagamihara; Hideaki Takahashi, Atsugi; Katsuji Sekita, Hiratsuka; Ichio Akami, Atsugi, all of Japan

[73] Assignee: Amada Company, Limited, Japan

[21] Appl. No.: 651,754

[22] Filed: Sep. 18, 1984

[30] Foreign Application Priority Data

| | | | |
|---|---|---|---|
| Sep. 21, 1983 | [JP] | Japan | 58-144936[U] |
| Sep. 21, 1983 | [JP] | Japan | 58-144937[U] |
| Sep. 22, 1983 | [JP] | Japan | 58-145887[U] |
| Sep. 22, 1983 | [JP] | Japan | 58-145888[U] |
| Oct. 18, 1983 | [JP] | Japan | 58-193356 |
| Oct. 20, 1983 | [JP] | Japan | 58-195186 |
| Oct. 20, 1983 | [JP] | Japan | 58-195187 |
| Oct. 25, 1983 | [JP] | Japan | 58-164009 |

[51] Int. Cl.[4] ..... B21D 5/02

[52] U.S. Cl. ..... 72/21; 72/389; 72/453.01

[58] Field of Search ..... 72/389, 482, 465, 456, 72/21, 452, 453.01; 100/99, 214

[56] References Cited

U.S. PATENT DOCUMENTS

| | | | |
|---|---|---|---|
| 3,214,955 | 11/1965 | Voth | 72/389 |
| 3,353,397 | 11/1967 | Hoffmann | 72/465 |
| 3,587,286 | 6/1971 | Fritsch | 72/389 |

FOREIGN PATENT DOCUMENTS

| | | | |
|---|---|---|---|
| 251182 | 8/1948 | Switzerland | 72/452 |
| 780165 | 7/1957 | United Kingdom | 72/452 |

*Primary Examiner*—Daniel C. Crane
*Attorney, Agent, or Firm*—Wigman & Cohen

[57] ABSTRACT

A vertical, hydraulic bending press has a ram which is connected with the hydraulic cylinder so that an even and uniform sectional modulus is applied over the full length of the ram to decrease stress concentration of the ram during bending of the workpiece. The press frame includes means for guiding the ram. Additionally, a load detection device is provided on either side of the ram so that the ram may be stopped when misloading of the ram is detected.

4 Claims, 12 Drawing Figures

BENDING PRESS

BACKGROUND OF THE INVENTION

1. Field of the Invention

The present invention relates to bending presses such as press brakes for bending sheet-like workpieces such as sheet metals and, more particularly, to hydraulic bending presses in which the ram carrying a bending tool is vertically operated by hydraulic means.

2. Description of the Prior Art

As is well-known, a bending press such as a press brake for bending sheet-like workpieces such as sheet metals is provided with a pair of elongated upper and lower bending tools which are horizontally disposed in vertical alignment with each other. One of the upper and lower bending tools is horizontally fixed, while the other is so arranged as to be vertically moved by a ram toward and away from the fixed bending tool with its length kept horizontal to bend a workpiece. Usually, the lower bending tool is fixed and the upper bending tool is horizontally mounted on the ram to be vertically moved toward and away from the lower bending tool, but, in some bending presses, the upper bending tool is fixed and the lower bending tool is movably held by the ram. In either case, the workpiece to be bent is placed or held on the lower bending tool, whether the lower bending tool is fixed or movable, so that the workpiece may be bent when either of the upper and lower bending tools which is movable is vertically moved by the ram toward the other tool which is fixed. Generally, the ram is of a rigid plate-like member which is provided at one of its edges with a straight surface to hold the movable bending tool horizontally, and it is vertically disposed with its flat sides vertical in such a manner as to hold the movable bending tool in vertical alignment with the fixed bending tool. Also, in many bending presses, the ram is hydraulically operated by hydraulic means such as hydraulic cylinders and is guided by guide means such as guide bars and rollers to vertically move the movable bending tool toward and away from the fixed bending tool.

The bending presses of the above described construction are classified broadly into two types according to the manners in which the ram is pressed by the hydraulic means and is guided by the guide means to enable the elongated movable bending tool to bend the workpiece in cooperation with the fixed bending tool which is also elongated. One of the types is so constructed that the ram is pressed by the hydraulic means and guided by the guide means at the central portion thereof, and the other type is so constructed that the ram is pressed and guided at both sides thereof.

The bending press in which the ram is pressed and guided at the central portion thereof is superior in bending accuracy, manufacturing cost and constructional simplicity to the type of bending press in which the ram is pressed and guided at both sides. Also, since the elongated fixed and movable bending tools are inevitably bent or curved more or less according to bending pressure during bending operations, it is desirable that the ram be pressed by a single hydraulic means so that the movable bending tool may be curved into an arched or bow-like shape together with the fixed bending tool to perform an accurate bending operation.

In general, however, the bending press in which the ram is pressed and guided at the central portion is additionally provided, for the sake of construction, with a single or plural auxiliary hydraulic means in addition to the main hydraulic means. Usually, two additional auxiliary, hydraulic means are symmetrically provided at the sides of the main hydraulic means which is located at the central portion of the ram.

One of actual disadvantages with the above described arrangement is that the movable bending tool will be bent by the plural hydraulic means into a wavy shape during a bending operation while the fixed bending tool will be bent into an arched shape. Accordingly, the movable bending tool will press the workpiece in the wavy state onto the fixed bending tool which will be bent into the arched shape with a result that the bending accuracy is decreased. Also, since many notches and holes are formed on the ram to dispose the plural hydraulic means, the ram will be inevitably uneven so much in section modulus over the length thereof so as to cause stress concentration. Thus, the notches and holes and the resultant stress concentration will cause undesirable effects on the ram to decrease the rigidity of the ram and the bending accuracy. Furthermore, it has been difficult to provide the guide means for guiding the ram in a desirable manner because of the additional hydraulic means. Therefore, there has been a disadvantage that reaction will occur against the offset load only at the guide means for the main hydraulic means located at the central portion of the ram when a smaller workpiece is being bent by the movable and fixed bending tools apart from or off the center of the ram. Thus, the guide means will fail to cope with the reaction and will allow the ram to slant and cause the movable and fixed bending tools to be out of parallel with each other so that the bending accuracy will be greatly decreased.

SUMMARY OF THE INVENTION

It is an object of the present invention to provide a bending press in which the ram is even and uniform in section modulus over the full length thereof to decrease the stress concentration so that the movable bending tool will be bent or curved in conformity with the fixed bending tool during bending operation.

It is another object of the present invention to provide a bending press in which the ram will cope with offset load to keep the movable and fixed bending tools in parallel with each other when a smaller workpiece is being bent by the movable and fixed bending tool apart from or off the center of the ram.

It is another object of the present invention to provide a bending press in which the guide means for the ram will not be affected by the bend or deformation of the ram and related portions during bending operations so that the ram can be smoothly moved up and down.

It is therefore a further object of the present invention to provide a bending press which will increase the bending accuracy.

In order to attain these objects, the bending press according to the present invention is so arranged that the ram is substantially square in shape and the hydraulic means for operating the ram are disposed at or in the proximity of the center of the ram and also the guide means for the ram are located at both sides of the ram. Also, the guide means for the ram are disposed between buffer means which are provided on both the ram and the base of the bending press so that the guide means will not be affected by the bend or deformation of the ram.

Other and further objects and advantages of the present invention will be apparent from the following description and accompanying drawings which, by way of illustration, show preferred embodiments of the present invention and the principle thereof.

DESCRIPTION OF THE PREFERRED EMBODIMENT

Figure 1:
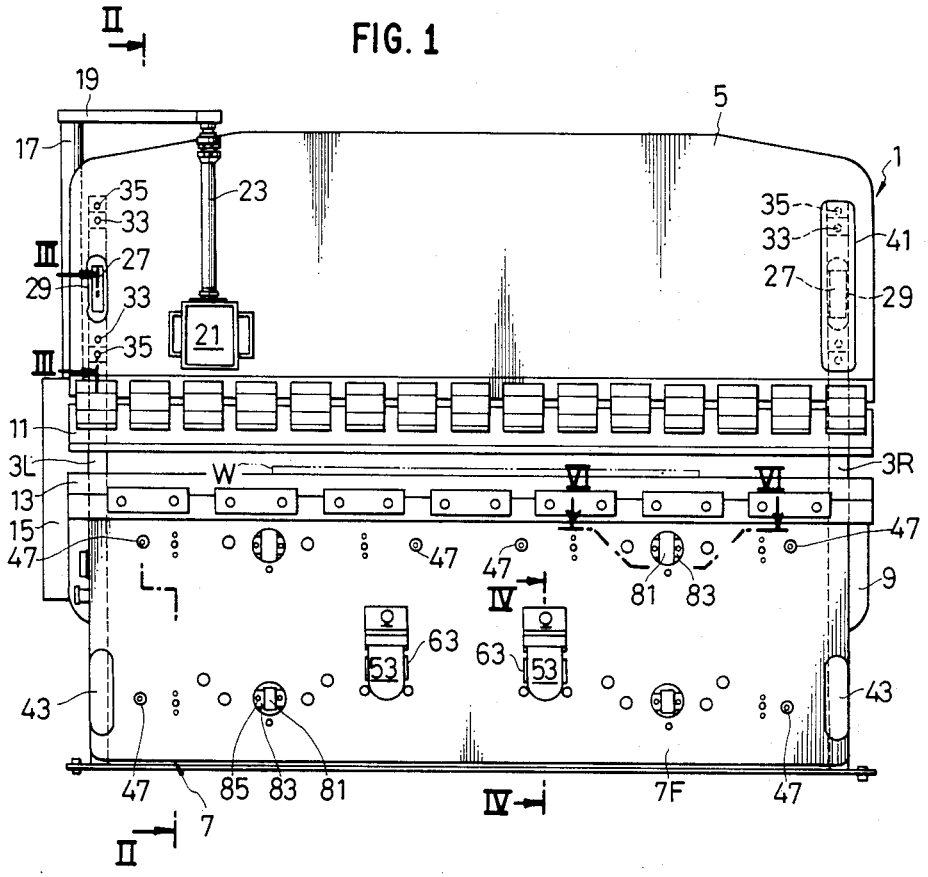
FIG. 1 is a front view of a bending press embodying the present invention.
Figure 2:
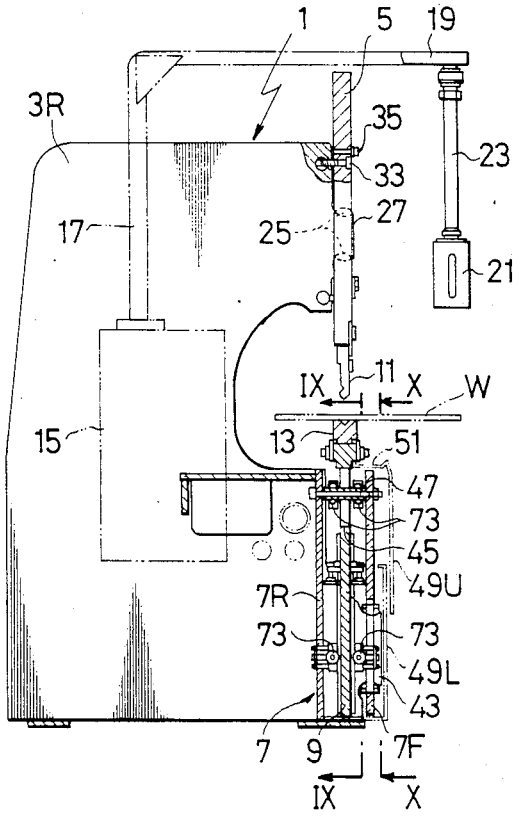
FIG. 2 is a cross-sectional view taken along the line II—II in FIG. 1.

Referring now to FIG. 1 and FIG. 2, a bending press 1 comprises a pair of C-shaped left-hand and right-hand side frames 3L and 3R, and an upper frame 5 and a lower frame 7 which are supported by the left and right side frames 3L and 3R at both sides, and a ram 9 in a slightly elongated shape, which moves freely in the vertical direction.

The lower frame 7 comprises a plate-shaped front frame 7F and a plate-shaped rear frame 7R which are separated from one another in the front and rear directions. Between the front frame 7F and the rear frame 7R, the ram 9 is provided so that it is able to move freely in the vertical direction. On the upper section of the ram 9, an upper tool 11 is mounted in a freely removable manner on the lower section of the upper frame 5, and a lower tool 13, which works in cooperation with the upper tool 11 to carry out the bending operation on a plate-shaped workpiece, is also mounted in a freely removable manner. In other words, this embodiment of the present invention illustrates a bending press of the type in which the conjunction of the upper tool 11 and the lower tool 13 is carried out by moving the ram 9 in the upward direction, and in addition, it should be understood that the present invention can be applied to a bending press of the type in which the operation of bending the work piece can also be carried out by the movement of the ram in the downward direction.

Figure 3:
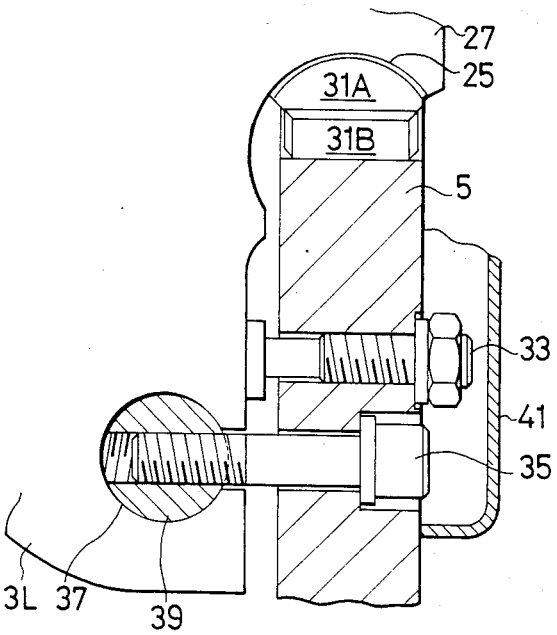
FIG. 3 is an enlarged cross sectional view taken along the line III—III in FIG. 1.

As shown in FIGS. 1 and 2, a box-shaped control panel 15 is mounted on one side frame 3L. In this control panel 15, the base section of an arm member 19, which is constructed so that its length is freely adjustable, is supported on the upper end of a support 17, which is installed in a freely rotatable manner. The arm member 19 extends in the horizontal direction, and on its tip a support bar 23, on the lower end of which is provided a control panel 21, is supported in a freely rotatable manner. Accordingly, the control panel 21 is able to move over a comparatively wide range, which improves the operating capability of the control panel 21. As shown in detail in FIGS. 1 and 3, the upper frame 5 is mounted vertically in a freely adjustable manner with respect to the side frames 3R and 3L. That is to say, as shown in detail in FIGS. 1 and 3, on the front surface of the top section of the side frames 3R and 3L, a protruding section 27 is formed in the shape of a short arc and provided with an arc-shaped bearing surface 25. The protruding section 27 is inserted into an elongated hole 29 which is formed in the upper frame 5 and runs in the vertical direction. A plurality of blocks 31A and 31B are interpositioned between the vertical, arc-shaped bearing surface 25 of the protruding section 27 and the elongated hole 29 of the upper frame 5. The blocks 31A and 31B contact one another at their mutual horizontal surface, and the center axis of block 31A is parallel to the ram, and the center axis of block 31B is horizontal to the ram, so that their mutual axes are at right angles. In order to secure the upper frame 5 to the right and left side frames 3L and 3R, a pair of thrust bolts 33 and a pair of draw bolts 35 are respectively provided in a location in the vertical direction to the elongated hole 29. The upper thrust bolt 33 is secured to the upper frame 5, and that end is placed against the front edge of the side frames 3R and 3L. In addition, each of the draw bolts 35 penetrates the upper frame 5, and the penetrating end is screwed into a cylindrical nut member 39 which is fitted so that it is capable of rotating in a hole 37 in the side frame 3R or 3L. Furthermore, the thrust bolts 33 and the draw bolts 35 are usually covered with a removable cover 41 which is fitted to the upper frame 5.

By means of this configuration, through the suitable adjustment of the thrust bolts 33 and the draw bolts 35 in the vertical direction, the upper frame 5 can be suitably inclined in the front and rear directions, and therefore the degree of verticality of the upper frame 5 can be adjusted. On that occasion, the respective thrust bolts 33 and draw bolts 35 are positioned, not in the horizontal direction, but rather in the vertical direction, therefore, even if the thrust bolts 33 and draw bolts 35 are overtightened, the area in the vicinity of the central section of the upper frame 5 is not distorted in the front-rear direction. That is, the upper frame 5 can be fitted and secured accurately in relation to the side frames 3R and 3L.

Once again referring to FIGS. 1 and 2, a protruding section 43 is formed on the lower section of the left and right side frames 3L and 3R, in the same way as the protruding section 27. On the protruding section 43, by means of the same type of configuration as the supporting structure of the upper frame 5 relative to the protruding section 27, the front frame 7F is supported relative to the lower frame 7. Both ends of the rear frame 7R on the lower frame 7 are integrally secured to the right and left side frames 3R and 3L by a suitable securing means. The ram 9 is installed between the rear frame 7R and the front frame 7F so that it is freely movable in the vertical direction. The rear frame 7R and the front frame 7F are integrally secured by a plurality of tie rods 47 which penetrate a plurality of vertical elongated holes 45 in a plurality of locations in the ram 9.

As shown in FIG. 2, the front frame 7F is covered by a lower cover 49L secured to the side frames 3R and 3L, and an upper cover 49U mounted on the ram 9. A tool post 51 is formed, extending in the left-right direction on the upper section of the upper cover 49U. Accordingly, during the removal and replacement of the upper and lower tools 11 and 13, various types of tools can be mounted on the tool post 51, which is exceedingly convenient.

Figure 4:
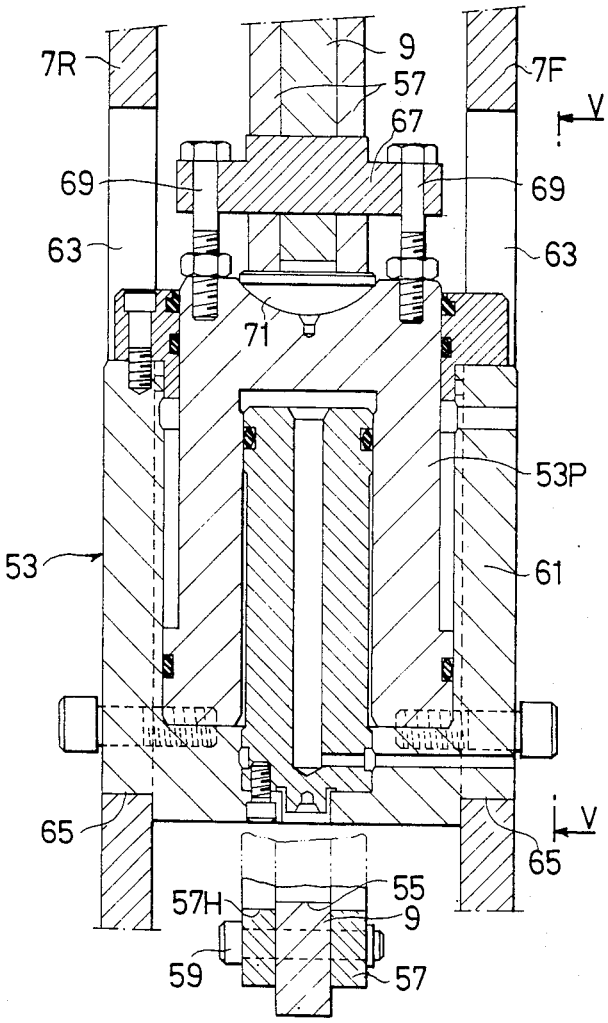
FIG. 4 is an enlarged cross-sectional view taken along the line IV-IV in FIG. 1.
Figure 5:
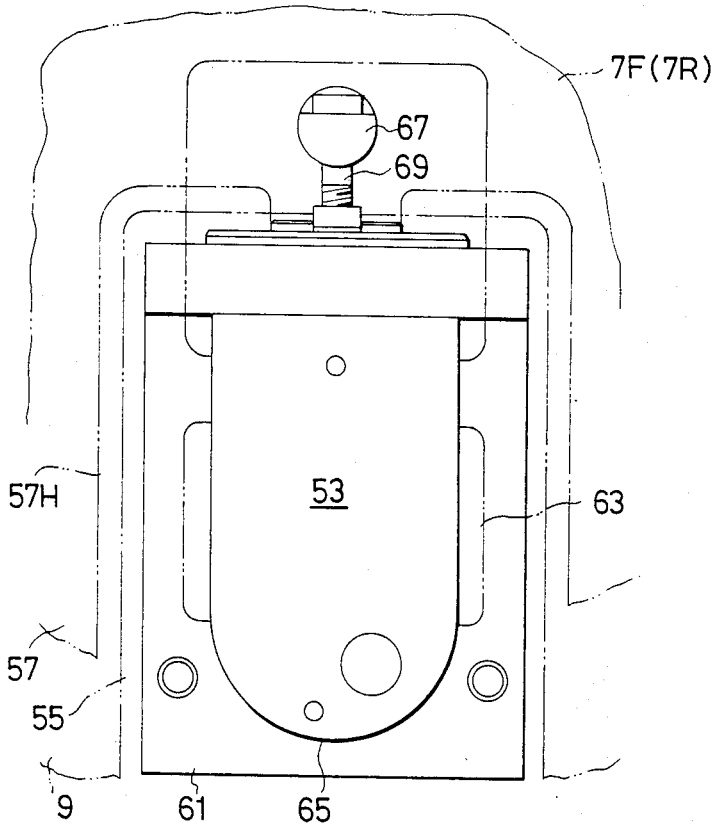
FIG. 5 is a view seen in the direction of the arrows V—V in FIG. 4.

As shown in detail in FIGS. 1, 4, and 5, in order for the vertical action of the ram 9 to take place, a plurality of hydraulic cylinders 53 are installed as lifting devices in the vicinity of the central section of the ram 9. In addition, a means is adopted to avoid a concentration of stress at the contact section of a piston rod 53P in the hydraulic cylinder 53 and the ram 9 when the ram 9 moves in the vertical direction by means of the hydraulic cylinders 53.

Figure 11:
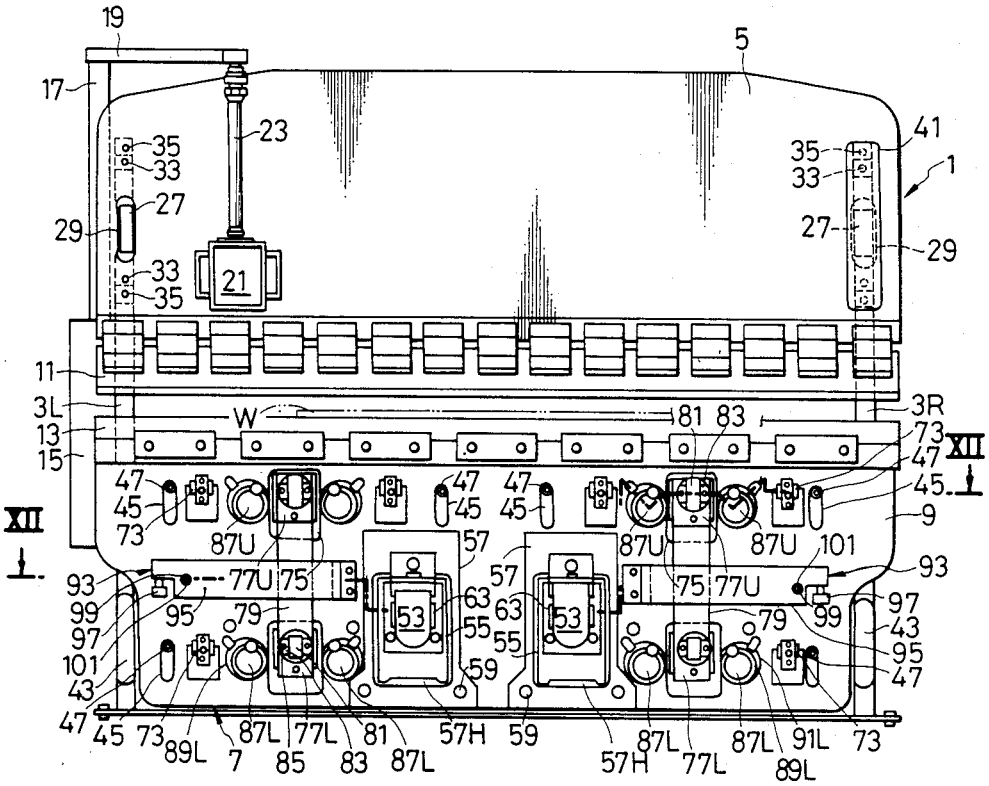
FIG. 11 is a front view of the bending press according to FIG. 1 with the lower front cover portion thereof removed.

In more detail, as shown in FIG. 11, in the approximate center section of the ram 9, a comparatively large cylinder housing orifice 55, for housing the hydraulic cylinder 53, is provided in a horizontally symmetrical position. Corresponding to the cylinder housing orifice 55, a ram support member 57 is positioned in both the front and back surfaces of the ram. At a slight distance from the cylinder housing orifice 55, an annulation, providing a large orifice 57H, is formed in the ram support member 57. The lower section of the ram supporting member 57, is secured to the ram 9 by a plurality of securing pins 59 or by some other securing means such as welding. As shown in detail in FIGS. 4 and 5, on a casing 61 of the hydraulic cylinder 53 which is housed within the cylinder housing orifice 55, an arc-shaped mating section 65 is formed, which mates with and supported on the lower arc section of a cylinder support orifice 63, which is formed in the front frame 7F and the rear frame 7R. The piston rod 53P of the hydraulic cylinder 53 is coupled to the ram 9 and the ram support member 57 through a bolt 69 and a pin 67 which penetrates the ram 9 and the ram support member 57. The end of the piston rod 53P does not bear against the ram 9, but bears against the ram support member 57 through a spherical seat 71.

By means of this configuration, because the casing 61 of the hydraulic cylinder 53 is able to protrude outward from the inner wall of the front frame 7F and the rear frame 7R, in the lower frame 7, the space between the front frame 7F and the rear frame 7R can be made comparatively narrow. In addition, when the ram 9 moves vertically the ram 9 is not thrust up directly, by means of the piston rod 53P of the hydraulic cylinder 53, but the ram 9 is caused to move upward by being pushed from the bottom direction by the ram support member 57. Because of the reduction of the sectional modulus of the ram 9 as a result of compensation by the ram support member 57 by means of the cylinder housing orifice which is formed in the ram 9, the force acting in the ram 9 is dispersed. Because of this dispersion, the problem resulting from the concentration of stresses is terminated. Accordingly, when the bending operation is carried out on the workpiece W, the distortion of the ram 9 becomes uniform, and the bending precision can be upgraded further.

Figure 12:
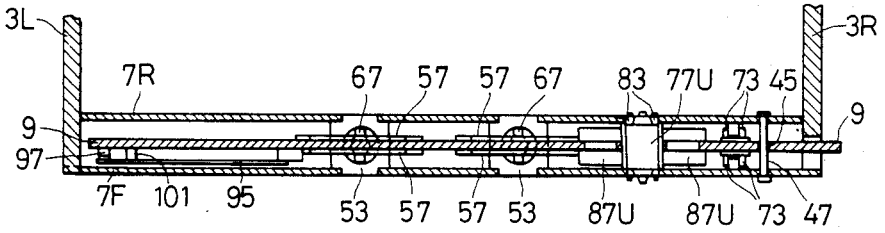
FIG. 12 is a sectional view along line XII—XII in FIG. 11. de

Referring now to FIGS. 2, 11 and 12 at a plurality of locations on the front frame 7F and the rear frame 7R of the lower frame 7, a stopper guide roller 73 to prevent oscillation of the ram 9 in the forward and rear directions is suitably installed. In addition, in the upper and lower sections in the vicinity of the right and left sides of the front frame 7F and the rear frame 7R, a plurality of guide blocks 77U and 77L are installed, penetrating through holes 75 in the ram 9. The guide blocks 77U and 77L are integrally connected through a connecting member 79.

Figure 6:
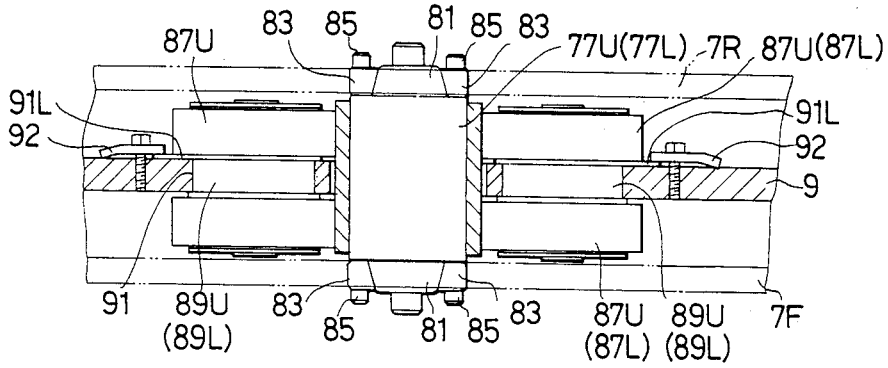
FIG. 6 is an enlarged sectional view taken along the line VI—VI in FIG. 1.

As shown more clearly in FIG. 6, on the front and back surfaces of the vertical guide blocks 77U and 77L a trapezoid-shaped protruding section 81 is formed, and a wedge member 83 is installed by means of, a plurality of bolts 85 on either side of the protruding section 81 and in a circular hole each provided in the front frame 7F and the rear frame 7R. Accordingly, by adjusting the position of the wedge member 83, the guide blocks 77U and 77L can be vertically adjusted.

On the ram 9, a plurality of vertical guide rollers 87U and 87L, which contact both perpendicular surfaces of the guide blocks 77U and 77L, are supported in a freely rotatable manner through the medium of a plurality of eccentric shafts 89U and 89L. The eccentric shafts 89U and 89L are fitted in a freely rotatable manner into an orifice 91 formed in the vertical section of the ram 9, and a disc-shaped securing leaf 91L integral with each the eccentric shafts 89U, 89L is held by pressure against the ram 9 by means of a fixed tool 92 provided on the ram 9, and is freely secured in an optionally rotatable position.

By means of this configuration, the ram 9 is prevented from oscillating in the forward and rearward directions by the plurality of guide rollers 73, and, at the same time, is guided vertically by the vertical guide blocks 77U and 77L. When the bending operation of the workpiece W is carried out by the vertical movement of the ram 9, for example, in the case where a one-side load is applied to the ram 9, the bending moment from that one-side load is uniformly received through the medium of the guide rollers 87U and 87L by means of the horizontal guide blocks 77U and 77L, in order to prevent only one side of the ram 9, which is subjected to a one-side load, from having a large distortion, whereby the bending operation can be performed with excellent precision.

Furthermore, with reference to FIG. 1, a one-side load detection device 93 is provided for detecting large one-side loads in the vicinity of the left- and right-hand side sections of the ram 9. The one-side load detection device 93 comprises a detection bar 95, which is secured to the ram at one end thereof in a location in close proximity to the hydraulic cylinder 53 to extend horizontally in the left- and right-hand directions, and a detection device 97, such as a limit switch, which is depressed by the other end of the bar. In the proximity of the tip section of the detection bar 95, which is operated by the other end of the bar, a pin 99 which is secured to the ram 9, is supported by a ring-shaped reinforcing body 101, which can be made of rubber.

By means of this configuration, the one-side load operates on one side of the ram 9, and when one side of the ram 9 has a large distortion it is possible to detect the one-side load by means of the detection bar 95 and the detection device 97. Accordingly, when the detection device 97 is moved by the application of a large one-side load, an emergency stop is performed, improving the safety of the operation.

Figure 7:
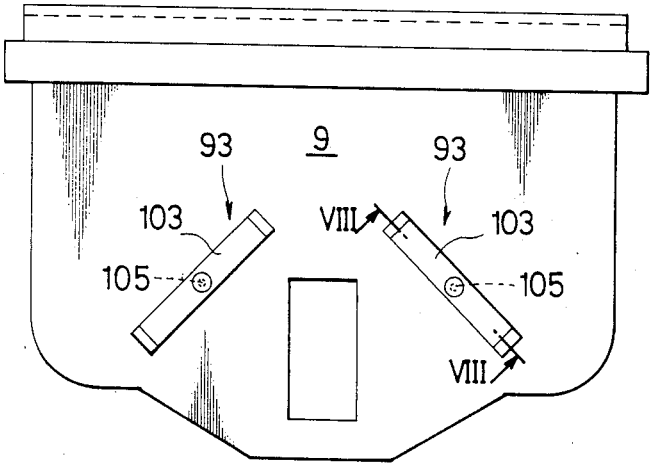
FIG. 7 is a front view of a second embodiment of the present invention.
Figure 8:
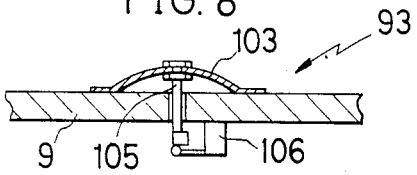
FIG. 8 is a cross-sectional view taken along the line VIII—VIII in FIG. 7.

FIGS. 7 and 8 show another embodiment of the one-side load detection device 93. In this embodiment, both ends of a detection member 103, which takes the shape of an arch, are secured to the ram 9, and a detection device 106 mounted on the ram 9 is operated by means of a dog 105 provided at the center section of the detection member 103. The results obtained are the same as for the previously-described embodiment of the present invention.

Figure 9:
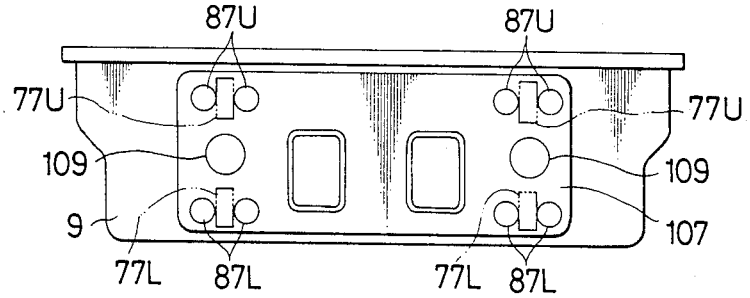
FIG. 9 is a sectional view showing a second embodiment of the portion which is to be seen in the direction of the arrows IX—IX in FIG. 2.
Figure 10:
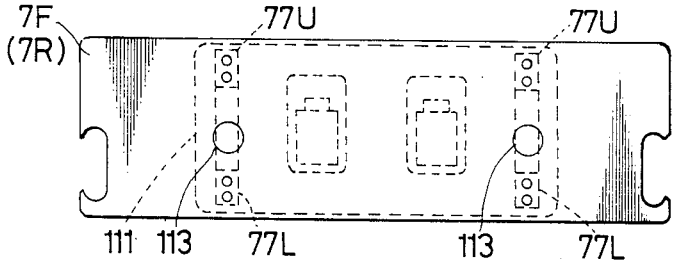
FIG. 10 is a sectional view which shows the same embodiment as that shows in FIG. 9 but is to be seen in the direction of the arrows X—X in FIG. 2.

FIGS. 9 and 10 shows a second embodiment of the ram guide section of the present invention. Both sides of a plate-shaped first compensating guide member 107, installed at both the front and rear surfaces of the ram 9, are pivotally attached to the ram 9 by means of a plurality of pins 109, and the guide rollers 87U and 87L are mounted on the first compensating guide member 107. In addition, plate-shaped second compensating guide members 111 similar to the plate-shaped first compensating guide member 107, are pivotally attached by means of a plurality of pins 113 to the front frame 7F and the rear frame 7R on the lower frame 7, and the second compensating guide member 111 is supported by the guide blocks 77U and 77L.

In this second embodiment of the present invention, when the bending operation is performed on the workpiece W, even in the case where a large distortion is produced on the center section of the ram 9 and the center section of the lower frame 7, the first and second compensating guide members 107 and 111 are always maintained horizontally because they are axially supported by the pins 109 and 113, and the vertical operation of the ram 9 is smoothly obtained.

From the above explanation of the embodiments of the present invention it can be understood that by means of the present invention, during the bending operation of the workpiece, even in the case where a one-side load is applied to the ram, the distortion of the ram is always uniform and a highly precise bending operation is accomplished. In addition, even when distortion is produced in the ram, the vertical operation of the ram is smoothly performed.

Furthermore, the invention being thus described, it will be obvious that the same may be varied in many ways. Such variations are not to be regarded as a departure from the spirit and scope of the invention, and all such modifications are intended to be included within the scope of the following claims.

What is claimed is:

1. A bending press, comprising:

a lower tool mounted on a lower frame having longitudinally disposed front and rear frame members;

an upper tool mounted on an upper frame;

guide blocks mounted on the frame;

a vertically movable ram mounted on the lower frame for bending cooperation of said lower and upper tools, said ram being mounted within the front and rear frame members and longitudinally disposed in the same plane as said front and rear frame members and surrounded by said frame members so as to be guided by the guide blocks, said ram having an opening near the center thereof, said lower tool being attached to said ram in a fixed position relative to said opening;

means for lifting the ram disposed in the opening, said means protruding through said opening, and being supported on the frame, said opening defined by a continuous surface in said ram with said lifting means being completely surrounded by said surface, wherein the ram is in closer proximity to the front and rear frame members than to the outside dimension, as measured in a direction perpendicular to the movement of the ram, of the means for lifting the ram, said means for lifting said ram moving in the same direction of movement as said ram;

the lifting means contacting a spherical seat on said ram so to provide a lifting force to the ram in a stress dispersing manner;

said guide blocks arranged to act on said ram on opposite sides of the lifting means.

2. The bending press of claim 1 in which said lifting device is a hydraulic cylinder having a piston rod of which is engaged with the stress dispersing spherical seat secured to the ram.

3. A bending press, comprising:

an upper tool and a lower tool mounted on a frame;

guide blocks mounted on the frame;

a vertically movable ram mounted within the frame and connected to one of said tools for bending cooperation of said tools, and further mounted within the frame so as to be guided by the guide blocks, said ram having an opening near the center thereof;

means for lifting the ram disposed in the opening and supported on the frame;

the lifting means contacting a spherical seat on said ram so to provide a lifting force to the ram in a stress dispersing manner;

said guide blocks arranged to act on said ram on opposite sides of the lifting means; and a distortion detection device for detecting the distortion of the ram, the device being installed in a symmetrical position on both sides of the ram.

4. A bending press, comprising:

an upper tool and a lower tool mounted on a frame;

guide blocks mounted on the frame;

a vertically movable ram mounted within the frame and connected to one of said tools for bending cooperation of said tools, and further mounted within the frame so as to be guided by the guide blocks, said ram having an opening near the center thereof;

means for lifting the ram disposed in the opening and supported on the frame;

the lifting means contacting a spherical seat on said ram so to provide a lifting force to the ram in a stress dispersing manner;

said guide blocks arranged to act on said ram on opposite sides of the lifting means further comprising;

a first compensating guide member pivotally attached to said ram and pivotally supporting the ram at both sides thereof, and a second compensating guide member pivotally supported on the fixed frame of the bending press at the both sides thereof and guiding the first guide member at the both sides thereof.

* * * * *